US009415909B2

(12) United States Patent
Druitt et al.

(10) Patent No.: US 9,415,909 B2
(45) Date of Patent: Aug. 16, 2016

(54) CLOSURE WITH AN EXTERNAL HINGE POSITIONED OUTSIDE A SIDEWALL OF THE CLOSURE

(75) Inventors: Rodney Druitt, Cheltenham (GB); Louis Lagler, Stäfa (CH)

(73) Assignee: Creanova Universal Closures Ltd., Tewkesbury (GB)

( * ) Notice: Subject to any disclaimer, the term of this patent is extended or adjusted under 35 U.S.C. 154(b) by 610 days.

(21) Appl. No.: 12/867,082

(22) PCT Filed: Feb. 11, 2009

(86) PCT No.: PCT/EP2009/051592
§ 371 (c)(1),
(2), (4) Date: Sep. 24, 2010

(87) PCT Pub. No.: WO2009/101117
PCT Pub. Date: Aug. 20, 2009

(65) Prior Publication Data

US 2011/0000137 A1 Jan. 6, 2011

Related U.S. Application Data

(60) Provisional application No. 61/028,801, filed on Feb. 14, 2008.

(51) Int. Cl.
*B65D 25/46* (2006.01)
*B65D 47/08* (2006.01)

(52) U.S. Cl.
CPC ..... *B65D 47/0809* (2013.01)

(58) Field of Classification Search
CPC ..... B65D 47/0809; B65D 47/0814; B65D 47/0838; B65D 2251/20
USPC ..... 215/206, 209, 216–221, 223, 230, 215/235–237, 245, 305, 306, 309; 220/254.3–254.5, 259.1, 281–283, 220/837–839; 222/108, 109, 111, 153.14, 222/556; 16/225; 49/399; D9/449
See application file for complete search history.

(56) References Cited

U.S. PATENT DOCUMENTS 3,135,456 A * 6/1964 Palazzolo ..... 229/125.11
3,902,598 A * 9/1975 Koob et al. ..... 206/398
4,403,712 A * 9/1983 Wiesinger ..... 220/839
4,414,705 A * 11/1983 Ostrowsky ..... 16/225
(Continued)

FOREIGN PATENT DOCUMENTS

DE 3625477 A1 * 2/1988
DE 10025265 A1 * 7/2001
(Continued)

OTHER PUBLICATIONS

International Search Report dated Apr. 22, 2009, issued in corresponding international application No. PCT/EP2009/051592.

*Primary Examiner* — Anthony Stashick
*Assistant Examiner* — Ned A Walker
(74) *Attorney, Agent, or Firm* — Pauley Erickson & Kottis

(57) ABSTRACT

The present disclosure is directed to a closure with an external hinge arrangement. The closure includes a lower closure part (2) and an upper closure part (3) which are functionally interconnected to each other by an external hinge arrangement (4). The external hinge arrangement includes a first and a second articulation element (5, 6) and at least one intermediate element (7, 8, 23).

10 Claims, 5 Drawing Sheets

(56) References Cited

U.S. PATENT DOCUMENTS

| | | | | | |
|---|---|---|---|---|---|
| 4,696,408 | A | * | 9/1987 | Dubach | 215/237 |
| 4,793,502 | A | * | 12/1988 | Beck | 215/235 |
| 4,809,874 | A | * | 3/1989 | Pehr | 220/833 |
| 4,848,612 | A | * | 7/1989 | Beck | 215/235 |
| 4,982,866 | A | * | 1/1991 | Krawagna | 220/838 |
| 5,007,555 | A | * | 4/1991 | Beck | 220/254.3 |
| D318,231 | S | * | 7/1991 | Lay et al. | D9/435 |
| 5,067,624 | A | * | 11/1991 | Thanisch | 215/235 |
| 5,143,234 | A | * | 9/1992 | Lohrman et al. | 215/235 |
| 5,148,912 | A | * | 9/1992 | Nozawa | 220/838 |
| 5,200,153 | A | * | 4/1993 | Carr et al. | 422/550 |
| 5,257,708 | A | * | 11/1993 | Dubach | 220/827 |
| D349,650 | S | * | 8/1994 | Lonczak et al. | D9/449 |
| 5,335,802 | A | | 8/1994 | Brach et al. | |
| 5,358,151 | A | * | 10/1994 | Strasenburgh | 222/420 |
| 5,435,456 | A | * | 7/1995 | Dubach | 220/838 |
| D370,845 | S | * | 6/1996 | Sherman et al. | D9/438 |
| 5,540,343 | A | * | 7/1996 | Schumacher | 215/235 |
| 5,558,239 | A | * | 9/1996 | Dubach | 215/235 |
| 5,746,338 | A | * | 5/1998 | Takahashi et al. | 215/237 |
| 5,794,308 | A | * | 8/1998 | Rentsch et al. | 16/225 |
| D402,202 | S | * | 12/1998 | Sherman et al. | D9/446 |
| 5,881,774 | A | * | 3/1999 | Utterberg | 138/89 |
| 5,913,435 | A | * | 6/1999 | Fuchs | 215/237 |
| 6,041,477 | A | * | 3/2000 | Rentsch et al. | 16/225 |
| 6,050,434 | A | | 4/2000 | McNab | |
| 6,114,165 | A | * | 9/2000 | Cai et al. | 435/304.3 |
| 6,152,320 | A | * | 11/2000 | Hierzer et al. | 220/838 |
| 6,415,965 | B2 | * | 7/2002 | Nyman et al. | 222/517 |
| 6,634,060 | B1 | * | 10/2003 | Lagler et al. | 16/225 |
| D492,597 | S | * | 7/2004 | Norris et al. | D9/442 |
| 6,766,926 | B1 | * | 7/2004 | Elchert | 222/498 |
| 6,786,363 | B1 | * | 9/2004 | Lohrman | 222/213 |
| 6,834,769 | B2 | * | 12/2004 | Takahashi et al. | 215/235 |
| 6,880,736 | B1 | * | 4/2005 | Gnepper | 222/556 |
| D508,402 | S | * | 8/2005 | Hierzer et al. | D9/449 |
| 6,971,531 | B1 | * | 12/2005 | Dubach | 215/235 |
| D515,917 | S | * | 2/2006 | Hierzer et al. | D9/447 |
| 7,073,679 | B1 | | 7/2006 | Lagler et al. | |
| D536,974 | S | * | 2/2007 | Smith et al. | D9/449 |
| D536,975 | S | * | 2/2007 | Smith et al. | D9/449 |
| D540,190 | S | * | 4/2007 | Larocca | D9/738 |
| D547,184 | S | * | 7/2007 | Kim et al. | D9/449 |
| D556,575 | S | * | 12/2007 | Nusbaum et al. | D9/449 |
| 7,314,150 | B2 | * | 1/2008 | Skillin | 222/498 |
| 7,322,493 | B2 | * | 1/2008 | Skillin | 222/517 |
| 7,472,797 | B2 | * | 1/2009 | Ostrowski | 215/306 |
| 7,510,095 | B2 | * | 3/2009 | Comeau et al. | 215/321 |
| 7,611,025 | B2 | * | 11/2009 | Nusbaum et al. | 215/253 |
| 7,617,954 | B2 | * | 11/2009 | Skillin | 222/556 |
| 7,762,438 | B2 | * | 7/2010 | Skillin | 222/556 |
| 7,810,663 | B2 | * | 10/2010 | Young | 215/253 |
| 8,074,821 | B2 | * | 12/2011 | Yeager | 220/254.3 |
| 8,256,643 | B2 | * | 9/2012 | Uytterhaeghe et al. | 220/836 |
| 8,292,101 | B1 | * | 10/2012 | Bragg et al. | 215/237 |
| 8,308,022 | B2 | * | 11/2012 | Barre et al. | 220/847 |
| 8,469,213 | B2 | * | 6/2013 | Ishii et al. | 215/252 |
| 8,523,025 | B2 | * | 9/2013 | Skillin et al. | 222/571 |
| 8,794,460 | B2 | * | 8/2014 | Druitt et al. | 215/235 |
| 2002/0096532 | A1 | * | 7/2002 | Berge et al. | 220/831 |
| 2003/0057209 | A1 | * | 3/2003 | Seelhofer | 220/259.1 |
| 2004/0111836 | A1 | * | 6/2004 | Lagler et al. | 16/225 |
| 2004/0256347 | A1 | | 12/2004 | Druitt et al. | |
| 2005/0087550 | A1 | * | 4/2005 | Skillin | 222/153.01 |
| 2005/0116382 | A1 | * | 6/2005 | Nusbaum et al. | 264/242 |
| 2005/0173367 | A1 | * | 8/2005 | Nusbaum et al. | 215/237 |
| 2005/0173368 | A1 | * | 8/2005 | Nusbaum et al. | 215/237 |
| 2006/0011667 | A1 | * | 1/2006 | Skillin et al. | 222/556 |
| 2006/0025718 | A1 | * | 2/2006 | Ostrowski | 604/74 |
| 2006/0163188 | A1 | * | 7/2006 | Lagler | 215/235 |
| 2006/0186077 | A1 | * | 8/2006 | Robinson | 215/237 |
| 2006/0201904 | A1 | * | 9/2006 | Comeau et al. | 215/237 |
| 2007/0000955 | A1 | * | 1/2007 | Barre et al. | 222/484 |
| 2007/0138124 | A1 | * | 6/2007 | Skillin | 215/235 |
| 2007/0228042 | A1 | * | 10/2007 | Yeager | 220/254.3 |
| 2007/0235406 | A1 | * | 10/2007 | Young | 215/253 |
| 2008/0035681 | A1 | * | 2/2008 | Skillin | 222/556 |
| 2008/0169261 | A1 | * | 7/2008 | Druitt et al. | 215/237 |
| 2008/0203106 | A1 | * | 8/2008 | Uytterhaeghe et al. | 220/838 |
| 2008/0264961 | A1 | * | 10/2008 | Sawyer | 220/810 |
| 2009/0026166 | A1 | * | 1/2009 | Druitt | 215/353 |
| 2009/0101646 | A1 | * | 4/2009 | Paul et al. | 220/254.4 |
| 2009/0152269 | A1 | * | 6/2009 | Pucci | 220/254.3 |
| 2010/0005641 | A1 | * | 1/2010 | Druitt et al. | 29/426.4 |
| 2010/0065589 | A1 | * | 3/2010 | Skillin | 222/556 |

FOREIGN PATENT DOCUMENTS

| | | | | |
|---|---|---|---|---|
| EP | 1147054 | | | 10/2001 |
| JP | 02-102368 | U | * | 8/1990 |
| WO | WO 99/57029 | A | | 11/1999 |
| WO | WO 2004/007313 | A | | 1/2004 |
| WO | WO 2005/007526 | | | 1/2005 |
| WO | WO 2007/031585 | A | | 3/2007 |
| WO | WO 2007031585 | A1 | * | 3/2007 |

* cited by examiner

CLOSURE WITH AN EXTERNAL HINGE POSITIONED OUTSIDE A SIDEWALL OF THE CLOSURE

CROSS REFERENCE TO RELATED APPLICATIONS

The present application is a 35 U.S.C. §371 National Phase conversion of PCT/EP2009/051592, filed Feb. 11, 2009, which claims benefit of U.S. Provisional Application No. 61/028,801, filed Feb. 14, 2008, the disclosure of which is incorporated herein by reference. The PCT International Application was published in the English language.

BACKGROUND

1. Field of the Disclosure

The present invention is directed to a hinged closure molded in closed position with an external snap hinge (living hinge) according to the preamble of the independent claims.

2. Related Art

WO2005/007526, assigned to Creanova A G, is directed to a hinged closure molded in a closed position, which is suitable to be used with carbonized beverages. The closure comprises a hinge and a latching mechanism, which is suitable to securely lock the closure such that it prevents unwanted opening. The hinge is integrated into a cylindrical outside structure of the closure. A seal is arranged on the inside and is in closed position sealingly engaged with a neck of a container.

U.S. Pat. No. 5,335,802, originally assigned to Creanova A G, describes a closure molded in a closed position. The closure consists of a tubular base portion and a hinged cap, whereby in a closed position the outer contour of the cap is within the interior contour of the base portion. The cap and the base portion are connected to each other in a single unit by a snap hinge comprising a main hinge connection. Extending from the snap hinge, cap and base portion are additionally connected together by a safety strap for tamper evidence. The inside of the closure may be equipped with an insert which is snapped into the closure. The hinge is integrated into the outer contour of the closure gap. The open position of the lid normally is at a 90° with respect to the closed position. This opening angle is insufficient for beverage closures.

EP1147054, assigned to Creanova A G, relates to a closed extruded plastic closure with a closure body and a lid, which are interconnected to each other by a snap hinge. The snap hinge comprises no main hinge connection and thereby achieves a large opening angle beyond 180°. Tamper evidence means are foreseen, which serve as original warranty seal. If required, an active element and a counter element serve as locking mechanism and prevent unintentional opening of the closure. In general, the lid has a smaller diameter then the body of the closure. The hinge is integrated into the outer contour of the closure.

US2004256347, of Druitt, Rodney Malcolm, is directed to a closure that comprises a top part with a skirt and a support ring that is engageable with the end portion of a container. The support ring is hingedly connected to the skirt by a hinge, which is not described in detail. The closure further comprises an annular sealing rib with a first vertical portion and a second portion that is arranged at an angle with respect to the first vertical portion. A problem consists in that the lid cannot be sufficiently opened due to the fact that the closure and the supporting ring are interconnected by a short hinge only, which significantly limits the freedom of movement.

WO04007313, assigned to Bericap, concerns a closure comprising a base portion and a cap comprising a base ring and a lid interconnected to each other by a strap. The strap enables the cap to be molded in closed position. Tamperproof means are provided between the ring and the top. One aim is to design the cap such that sensitive zones of the cap are either located in a sealed closed space, or capable of being in contact with a liquid (in solution or spray) and capable of being treated so as to eliminate said liquid, so as to sanitize the closure. The tamperproof means are deformed and ruptured when the top is first opened such that the resulting free ends are sufficiently spaced apart from each other, thus easily revealing to a user whether it has been tampered with. The hinge is a dead hinge without hinge action. One draw back of this closure results from the hinge which does not provide a sufficient snap effect such that the lid does not remain in an open position.

SUMMARY

It is an object of the present invention to provide a hinged closure molded in closed position with an external hinge, whereby the hinge external hinge is a living hinge which provides a snap effect.

A closure molded in a closed position according to the present invention in general includes two closure parts: when molded in closed position, an in general ring-shaped lower part (body) and a cap-like upper part (lid), which are functionally interconnected to each other by a hinge arrangement arranged (in a closed position of the closure) outside of said closure parts. In a view from the side, the hinge arrangement is in general C-shaped, whereby each end of the C are interconnected to one of the closure parts. The hinge arrangement comprises a first and a second articulation element protruding from the corresponding closure parts to which they are rigidly interconnected such that the closure behaves in a coordinated manner. The articulation elements are interconnected to each other by at least one intermediate element, which is delimited on at least two sides by film hinges made out of a thin web of material from the articulation elements. The at least one intermediate elements are arranged such that during opening and closing a snap effect results due to reversible deformation of certain components of the hinge arrangement occur. This is achieved by deformation which is resulting from the specific arrangement of the hinge components with respect to each other. The hinge arrangement normally comprises two positions where the implemented deformation reaches a minimum. These positions normally are the stable positions into which the hinge and the closure parts return after deflection. In-between two stable positions a non-stable equilibrium exists from which the closure parts tend to return to a stable position. In difference to the closures known from the prior art the herein disclosed external hinge concept allows to provide a real snap effect with two stable positions. This is important for the comfort of the consumer. A further advantage results from the fact that the hinge arrangement does not need a direct hinge connection between the upper and the lower closure parts. Thereby it becomes possible to design the hinge in a way that the lid in an open position is out and away from the orifice whereby the comfort to use the closure is increased.

One advantage of a closure with an external hinge results from the fact that the closure parts (lid and body) can be designed in a way such that they hermetically seal with respect to each other such that no contamination does occur e.g. inside the lid. In certain fields of application it is advantageous that the closure can easily be rinsed.

Very good hinge action can be achieved by two trapezoidal shaped intermediate elements arranged adjacent to each other. Depending on the hinge action to be achieved the film hinges delimiting the at least one intermediate element are arranged in a single plain and symmetric with respect to each other. To achieve an overall coordinated behavior of the hinge arrangement, the trapezoid elements are designed such that they are sufficiently torsional stiff. If the torsional stiffness is not sufficient, the hinge does not behave in a coordinated manner. The trapezoidal shaped intermediate elements (alternative expression: trapezoid elements) each are on two opposite sides interconnected to an adjacent articulation element via a film hinge (thin web of material). In a top view, when looking at the hinge arrangement in a closed position, the trapezoid elements are arranged with respect to each other in a V-shape (cross-section perpendicular to length direction), whereby the apex of the V in general points in the direction of a central axis of the closure. In an open position the V-shape is inverted (further details can be retrieved from the subsequent drawings). The trapezoid elements may be interconnected to each other along their facing edge directly via a film hinge or indirectly via a connecting element. Alternatively the two trapezoid elements may be spaced apart by a gap with respect to each other.

The trapezoid elements in general are having a trapezoid shape delimited on two opposite sides by film hinges. The film hinges are in general arranged within a plane and are divergent with respect to each other in the direction of the center of the closure (plane of symmetry). Thereby bases of the trapezoid elements are arranged in general opposite to each other. Depending on the hinge effect to be achieved the trapezoid elements are normally mirror symmetric with respect to each other. Alternatively they may deviate with respect to each other to achieve other effects. The bases of the trapezoids may be interconnected to each other directly by a film hinge or via an intermediate element. The short free edges of the trapezoid elements are normally arranged to the outside.

In an embodiment the intermediate element is designed as being bendable in a lateral, circumferential direction. The intermediate element has an in general uniform thickness and is in a closed position of the closure curved in a first direction. Due to the design of the hinge arrangement the curvature of the intermediate element is inverted in an open position.

The upper and the lower closure parts are normally interconnected to each other by tamper evident means such as frangible bridges or a thin web of material. Alternatively or in addition, a tear-off band may be foreseen. To securely indicate initial opening of a closure, the tamper evident elements may be arranged within a window. If appropriate, they may be arranged at an inclined manner or have an angled design. Alternatively or in addition, a thin web of material may be foreseen. By the specific design of the tamper evident means and the appropriate choice of material it is achieved that the tear-off elements are significantly stretched before they give way and allow full opening of the closure. By the choice of material it can be achieved that the tamper evident elements change their color (e.g. due to stress whitening). By designing the tamper evident elements specifically such that stress whitening occurs it becomes possible to securely indicating initial opening.

In difference to other hinges known from the prior art, the external hinge according to the present invention comprises no direct main hinge connection between the closure parts (upper and lower closure parts are not directly interconnected to each other by a film hinge). Thereby the upper and the lower closure part (body and lid) do not move on circular path with respect to each other. In difference to the prior art it becomes possible to move the lid out and away from a pouring opening.

In general the herein described hinge arrangement can be used with closures molded in open position. The hinge arrangement has an in general similar design but does not to be arranged inverted, i.e. extend diverge to the outside of the hinge.

The external hinge arrangement according to the herein disclosed invention are specifically suitable for closures molded in closed position. In this case the at least one trapezoid element normally has a concave shape with a negative curvature compared to the curvature of the closure parts body and lid, i.e. the trapezoid element does not follow the contour of the adjacent closure parts in a closed position of the closure but are curved in an opposite direction. By this inverse arrangement mold construction for making of the closure becomes more simple.

However, an external hinge can be made in open position still offering the advantages for aseptic applications, i.e. sealing off the area between the spout and the lid. In this case the trapezoid element(s) can be designed such that they follow the contour of the adjacent closure parts. No sophisticated inverse arrangement is necessary.

A closure according to the present invention can be manufactured in one piece or with or without a sealing liner from several types of plastic, such as Polyethylene (from now on PE) or Polypropylene (from now on PP). The latter is used for the shell manufacture as shell material of liner closures; the material is harder and less durable than PE. Softer material such as Low density PE (LDPE), ethylene vinyl acetate (EVA), compounds based on polyolefinic raw materials or EVM-based materials such as Darex are often used as liner material. More rigid materials such as PP are often used as a shell material of hinged closures. If appropriate a barrier liner can be applied between the sealing liner and the shell (lid) of the closure to prevent unwanted gas transmission. The barrier liner is made, preferably by injection molding, out of a barrier liner material such as polyvinylidene chloride (PVDC). PVDC has been known since a long time under the trade name SARAN® for wrapping products in the form of resins and films. PVDC works by polymerizing vinylide chloride with monomers such as acrylic esters and unsaturated carboxyl groups, forming long chains of vinylide chloride. The copolymerization results in a film with molecules bound so tightly together that very little gas or water can get through. The result is a barrier against oxygen, moisture, chemicals and heat-qualities used to protect food, consumer and industrial products. PVDC is resistant to oxygen, water, acids, bases, and solvents. Alternatively or in addition the barrier liner may be made out of a biodegradable material such as a PLANTIC®. Depending on the field of application and the material used the barrier liner can be made by injection molding, or by compression molding or by co-extruding or by stamping out of a sheet of material.

In an embodiment a closure according to the invention in general includes a lower closure part which is interconnected via an external hinge arrangement to an upper closure part. The external hinge arrangement comprises a first articulation element interconnected to the lower closure part, a second articulation element interconnected to the upper closure part and at least one intermediate element interconnected to the first and the second articulation element by a film hinge. The articulation elements and the thereto interconnected at least one intermediate element control the relative movement of the closure parts with respect to each other. The external hinge arrangement is in a side view in general C-shaped. In a preferred embodiment the closure is made in a closed position whereby the upper and the lower closure parts are interconnected by at least one tamper evident means to indicate initial opening of the closure. Good hinge performance can be obtained in that the hinge arrangement comprises a first and a second trapezoidal shaped intermediate element which are each interconnected by two film hinges to the first and the second articulation element. Snap effect can be improved in that film hinges are straight. If appropriate the two intermediate elements can be interconnected to each other directly or indirectly by at least one film hinge. The closure can be made in a closed position by a special design of the hinge arrangement, i.e. when the at least one intermediate element (or the intermediate elements are with respect to each other) is in a closed position of the closure concave shaped (arranged) not following the outer contour of the adjacent closure parts.

BRIEF DESCRIPTION OF THE DRAWINGS

The herein described invention will be more fully understood from the detailed description of the given herein below and the accompanying drawings, which should not be considered limiting to the invention described in the appended claims.

DETAILED DESCRIPTION OF THE EMBODIMENTS

Figure 1:
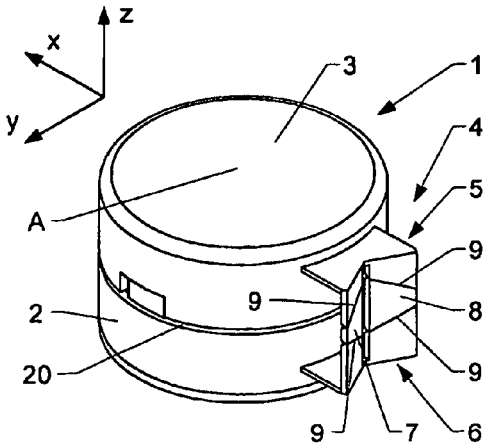
FIG. 1 shows a first embodiment of a closure in a perspective manner in a rear view.
Figure 2:
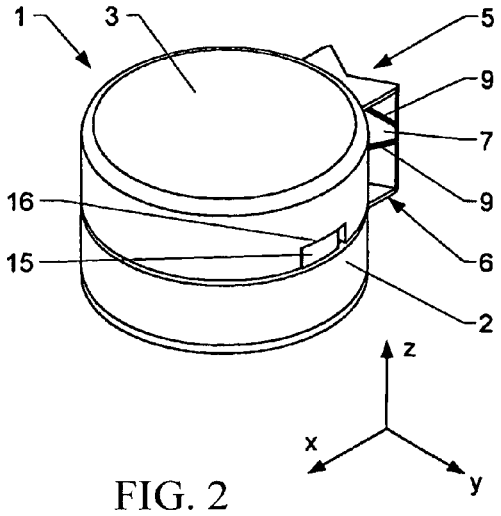
FIG. 2 shows the closure according to FIG. 1 in a perspective manner in a front view.
Figure 3:
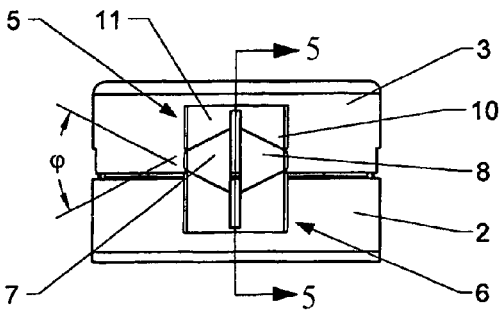
FIG. 3 shows the closure according to FIG. 1 in a rear view.
Figure 5:
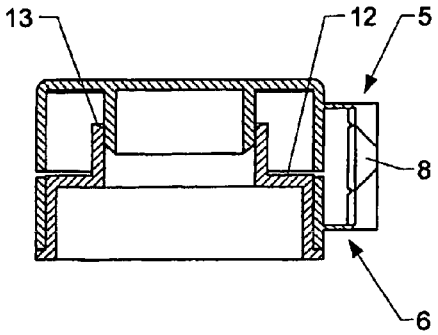
FIG. 5 a cross-cut along line AA of FIG. 3.
Figure 6:
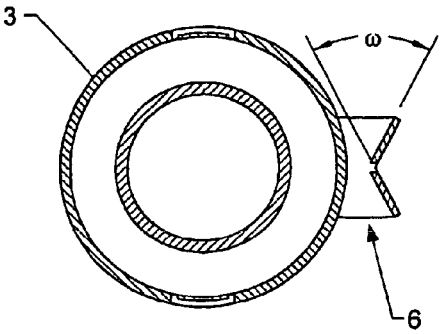
FIG. 6 a cross-cut along line BB of FIG. 4.
Figure 7:
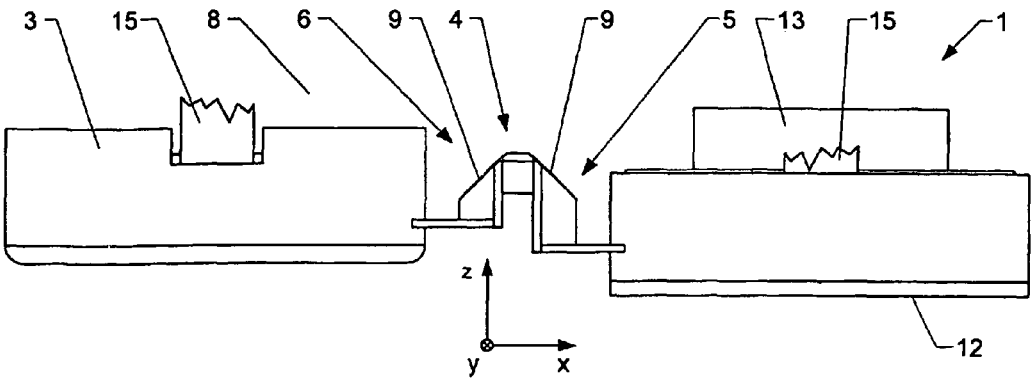
FIG. 7 the closure according to FIG. 1 in an open position in a side view.

FIG. 1 shows a first embodiment of a closure 1 in a closed position in a perspective manner from the rear and above. FIG. 2 shows the same closure 1 in a perspective manner from the front and above. FIG. 3 shows the closure 1 in a rear view and FIG. 4 in a side view. FIG. 5 shows a cross-cut through the closure 1 along line 5-5 of FIG. 3 and FIG. 6 shows a cross-cut along line 6-6 of FIG. 4. FIG. 7 is showing the closure 1 according to the FIGS. 1 to 6 in an open position in a side view and FIG. 8 in a perspective view from above.

The closure 1 is normally molded in a closed position and comprises an in general ring shaped base part 2 (body) and a cap like upper part 3 (lid) which are functionally interconnected to each other by an external hinge arrangement 4. The closure parts 2, 3 are in the shown embodiment cylindrically shaped and separated to each other by a circumferential gap 20. Other shapes are possible as long as they can be demoulded (e.g. see FIGS. 9 through 12).

The hinge arrangement 4 comprises a first (lower) and a second (upper) articulation element 6, 5 which are arranged protruding from the lower and the upper closure parts 2, 3. The articulation elements 5, 6 are functionally interconnected to each other by a first and a second trapezoid element 7, 8. The articulation elements 5,6 and the trapezoid elements 7,8 are connected to each other via hinge elements 9 in the form of film hinges (thin web of material made by injection molding).

In the shown embodiment the trapezoid elements 7, 8 are delimited to each other by a gap 17 which extends in a closed position in vertical direction here parallel to a closure axis A (z-direction).

Figure 4:
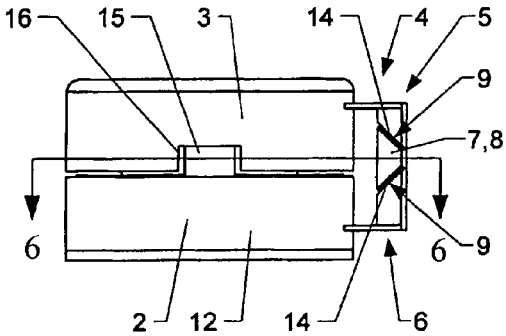
FIG. 4 shows the closure according to FIG. 1 in a side view.

As best can be seen in FIG. 4 (side view, y-direction) the hinge arrangement 4 is in general C-shaped extending above the outer contour of the closure parts 2, 3 and is designed such that it can be accessed in a molding position from the side (y-direction) by sliders (not visible), which form the inside of the hinge arrangement between the outer contour of the closure and the hinge arrangement. In that, the trapezoid elements 7, 8 are arranged such that they extend (unclench) in a lateral direction (y-direction), no hindering undercut results and demolding becomes possible. In the shown embodiment the film hinges 9 of each trapezoid element 7, 8 are arranged pairwise in planes (the planes of the trapezoid elements) incorporating an angle $\phi$. The film hinges are incorporated in the shown embodiment as grooves 14, arranged at the inside contour of the hinge arrangement 4. Alternatively or in addition, the grooves can be incorporated at the outside of the hinge arrangement 4. The grooves 14 define and determine a bending area along which the closure parts move with respect to each other. The grooves 14 have an in general V- or U-shaped cross section.

Figure 8:
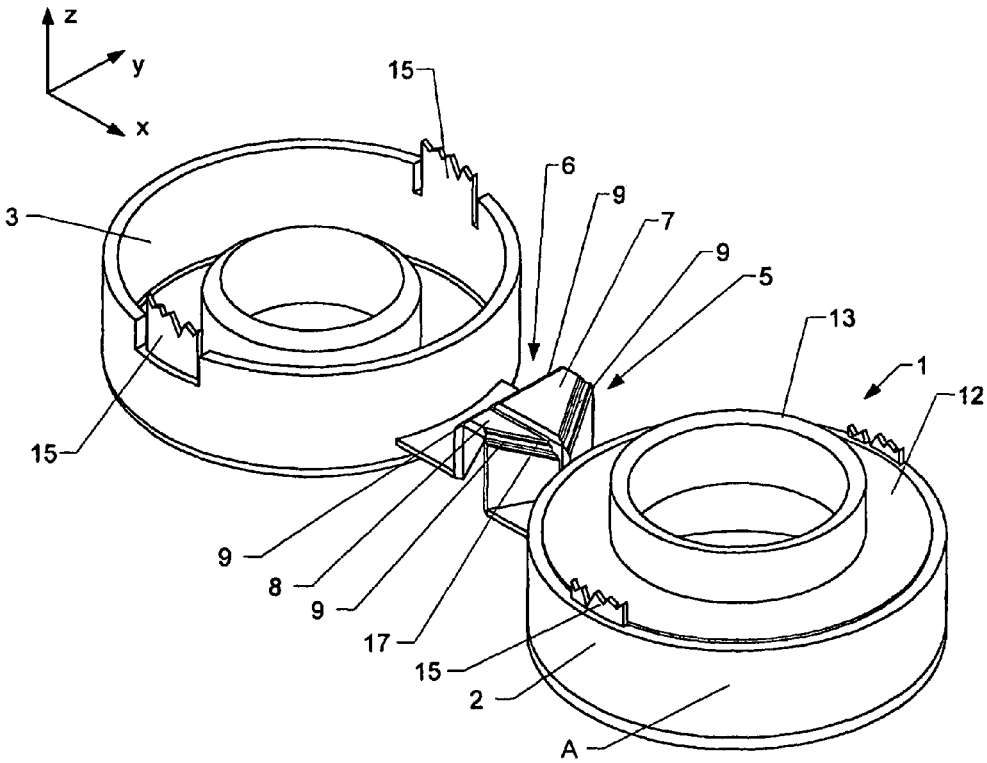
FIG. 8 illustrates a side perspective view of the closure according to FIG. 1 in an open position in a side view.
Figure 9:
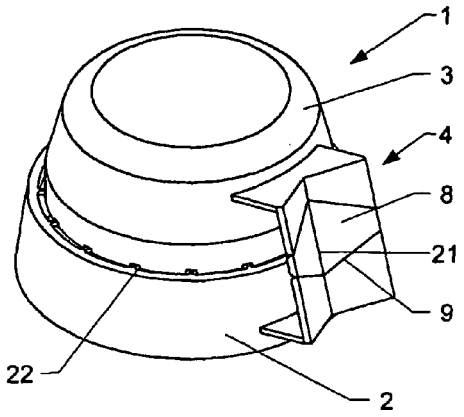
FIG. 9 is showing a second embodiment of a closure in a closed position in a perspective view from above.
Figure 10:
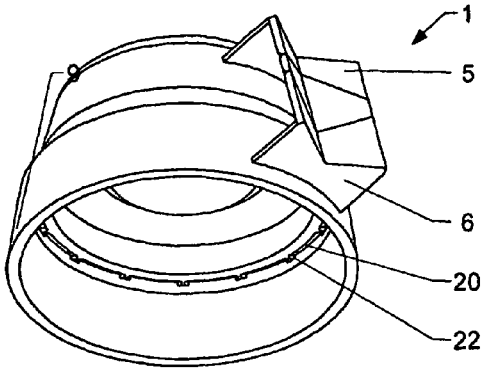
FIG. 10 the closure according to FIG. 9 in perspective view from below.
Figure 11:
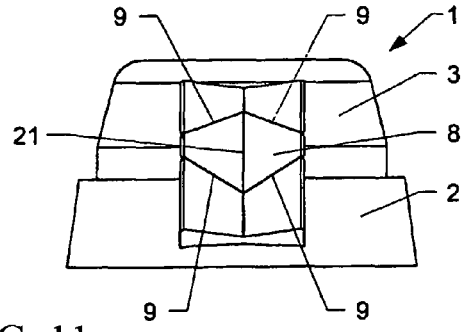
FIG. 11 the closure according to FIG. 9 in a back view.
Figure 12:
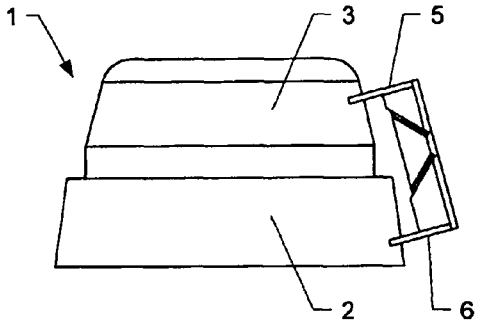
FIG. 12 the closure according to FIG. 9 in a side view.

FIGS. 7 and 8 show the closure 1 in an open position. A large opening angle $\alpha$, which guaranties that in open position the lid is sufficiently far away from the orifice is not achievable by conventional type of hinges, having a main hinge connection which connects the body and the lid directly, due to the reason that the opening angle of these conventional hinges is in the range of 130° only. The hinge of a closure according to the present invention does not have a main hinge connection between the closure parts, whereby an opening angle $\alpha$ of 200° to 240° may be achieved.

The trapezoid elements 7, 8 are preferably arranged substantially vertical (parallel to the side walls of the cylindrical closure 1) of if necessary inclined at a certain angle. Each of the trapezoid elements 7, 8 is connected by a film hinge 9 (thin web of plastic, defining a hinge action) via the articulation elements 5, 6 to the body 2 and the lid 3 of the closure 1. The two film hinges 9 adjoining the first and the second trapezoid element 7, 8 are arranged in a first and in a second plane 10, 11. The film hinges 9 of the first and the second plane 10, 11 are, with respect to each other, intersecting at an angle $\phi$ (see FIG. 3). The first and the second plane 10, 11, with respect to each other, are intersecting at an angle co. Depending on the field of application skew or asymmetric arrangements of the film hinges 9 are possible which result in different opening angles of the upper and the lower closure parts or a side movement (out of plane movement) during hinge action. In general the shorter free edge at the outside of hinge arrangement 4 of the trapezoid elements 7, 8 remains free. The relation between the opening angle α of the closure 1 the angle ω and the angle ϕ between corresponding film hinges 9 and the trapezoid elements 7, 8 is as follows:

$$\Phi/2 = a\tan\left[\frac{\sin(\alpha)}{1-\cos(\alpha)}\sin\left(\frac{\omega}{2}\right)\right].$$

As it can be seen in accordance with FIG. 6 (top view) the trapezoid elements 7, 8 are arranged V-shaped at an angle ω with respect to each other whereby the apex of the V is pointing at the inside of the closure (the centre). Thereby it becomes possible to access the inside of the C-shaped hinge arrangement 4 from a lateral direction. If the hinge arrangement would point in the opposite direction, the hinge would not easily be feasible by injection molding due to non-accessible areas (undercuts). In the shown embodiment the film hinges 9 are straight.

In certain embodiments it might be possible to design them slightly bend (e.g. when following a bend outside contour), although this would lead to significant reduction of the overall performance of the hinge arrangement and to hindering internal stress. In this situation the trapezoid elements have a bend shape which in a closed position is concave such that it can easily be accessed from a lateral direction. In open position the shape of the trapezoid elements is inverted (bend in opposite direction). One draw back of such a solution is that the inverting of the trapezoid elements results in a significant loss of snap effect.

The closure 1 parts may be connected directly or indirectly by further means such as locking means or means which are indicating tamper evidence or initial opening. If appropriate the closure is equipped with tamper evidence means, e.g. a tear-off band or frangible bridges, which are removed or destroyed during or prior to initial use, indicating first opening of the closure.

In the embodiment according to FIGS. 1 to 8 a tamper evident means 15 is incorporated in the form of a thin web of material 15 arranged in a window 16 between the upper and the lower closure parts 3,2. In general, the thin web of material has a thickness of 0.05 to 0.15 mm and may be equipped with stress concentrating means in the form of sharp notches or sections of reduced thickness A thin web of material 15 is arranged on either side of the closure 1 at 90° to the position of the hinge arrangement 4. The thin web of material 15 is designed such that it is significantly deformed (stretched) during initial opening of the closure 1 (see FIGS. 7, 8) before it finally breaks such that the lid 3 can be fully opened. By selecting a material which tends to change it's color during stretching (e.g. turns white), it is possible to additionally indicate to a consumer that the closure has been opened before. The herein described type of tamper evident means can be used for other (closed molded) closures.

As it can be seen in accordance with FIG. 5, the closure 1 as shown in FIGS. 1 to 8 comprises an insert 12 which is snapped into the lower part 2 of the closure 1 from beneath. The insert 12 extends across the ring shaped lower part 2 and provides a pouring opening 13, which sealingly interacts in a closed position with the lid 3. The insert 12 normally acts as an interface between the closure 1 and a neck finish onto which it is mount. If the lower part 2 is directly mount onto a suitable neck finish providing a pouring opening the insert 12 can be avoided.

In general, the ring-shaped lower part 2 (body, respectively base of the closure) of the closure 1 in general comprises a first fastening means (holding means), which are suitable to fix the lower part of the closure on a neck, e.g. of a container, by cooperation with corresponding opposite fastening means, such as axially spaced apart beads, arranged at the neck. The upper part 3 of the closure 1 may comprise second fastening means to detachably fix the upper part of the closure (lid) to the neck. E.g. it is possible to implement a bayonet type of locking mechanism in the lid of the closure, which interacts in a closed position with opposite locking means arranged at an orifice of a closure or an inside part of the cap. The bayonet type locking mechanism can be disengaged by rotating the closure around its vertical axis (z-direction). Good results are achieved in that the bayonet type of locking mechanism comprises 2, 3 or 4 pair of thread segments evenly distributed around the orifice. If appropriate, the thread segments may be arranged at different levels above each other (e.g. in two rows). If appropriate, the tread segments may be arranged at an inclined manner having a uniform or a variable pitch.

In an embodiment the second fastening means of the lid are of a bayonet-type. The bayonet-type second fastening means comprise first bayonet-segments arranged at the top part 3 of the closure 1 protruding laterally inwardly and suitable to interact in a closed position of the closure with corresponding second bayonet-segments arranged e.g. at a neck (not visible in detail) and protruding laterally outwardly. The first and the second bayonet segments are designed and arranged such that when the lid is moved with respect to the lower part on a path determined by the hinge the first and the second bayonet-segments mesh with each other in a first direction (direction of axis of rotation, respectively closure axis) when the lid is arranged above the neck. It is then possible to interlock the lid with respect to the neck by rotating at least the lid of the closure with respect to the neck by a certain angle around the closure axis (axis of rotation) such that the first and the second bayonet-segments securely mate with each other holding the closure in a closed position locked against relative axial movement. To avoid overturning of the closure stop elements may be foreseen, e.g. in that the bayonet-segments are designed such that they act as stop elements, and/or additional stop elements are arranged in the area between the lid and the neck. Such an arrangement may have the disadvantage that the bayonet-segments have a rather complicated design which might not be appropriate in certain fields of application. In an embodiment where the lid of the closure is at least in a closed position of the closure torsionally stiff interconnected to the base of the closure, alternatively or in addition stop elements preventing overturning of the closure may be foreseen in the area between the lower part of the closure (body) and the neck. This has the further advantage that the neck finish is more simple and in the mold design disadvantageous hindering undercuts can be avoided which results in a more simple mold design.

If appropriate the bayonet-segments can be designed/arranged such that by the rotation of the lid with respect to the neck, a seal in the lid is tightly pulled against the neck. This can e.g. be achieved in that the first and/or the second bayonet segments are arranged at least partially thread-like at an angle with respect to the circumferential direction or comprise a ramp. In an embodiment the bayonet-segments are arranged laterally spaced apart in circumferential direction at equal distances and at the same height (level) with respect to the closure axis (axis of rotation) or staggered at different levels. To improve the efficiency the bayonet segments may be arranged in several rows.

FIGS. 9 through 12 show a second embodiment of a closure 1 with an external hinge 4. The hinge arrangement 4 in general corresponds to the hinge arrangement 4 of the closure 1 according to FIGS. 1 to 8. Since the explanations given with respect to the closure 1 according to FIGS. 1 to 8 apply likewise to the closure 1 according to FIGS. 9 to 12, it will not be explained in detail again. As it can be seen the closure parts 2, 3 are conically shaped and the hinge arrangement 4 is arranged at inclined with respect to a center axis A of the closure 1. Tamper evidence means are incorporated in the form of thin bridges of material 22, which are destroyed during initial opening of the lid 3 of the closure 1. The bridges 22 are arranged in a circumferential gap 20 between the upper and the lower closure parts 2, 3. One difference which can be found is that the trapezoid elements 7, 8 of this second closure 1 are interconnected to each other by a vertical film hinge 21, which extends between the crosspoint of the upper and the lower film hinges 9 interconnecting the articulation elements 5, 6 and the trapezoid elements 7, 8. The closure 1 is foreseen to be applied directly onto a corresponding neck finish (not visible).

Figure 13A:
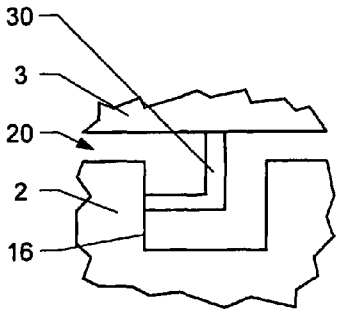
FIG. 13 a first embodiment of angled tamper evidence means.
Figure 13B:
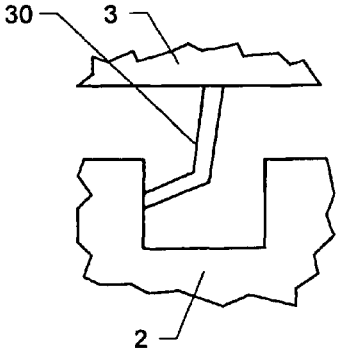
Figure 13C:
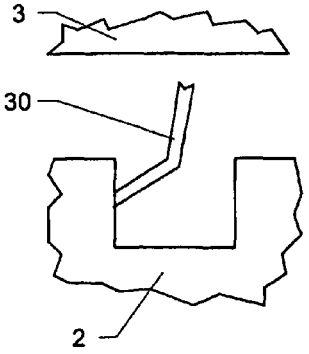

FIGS. 13 *a*) to *c*) show a further embodiment of a tamper evident element in the form of an angled bridge 25, which is arranged in a window 16 between the upper and the lower closure parts 3, 2 of a closure e.g. as shown in the FIGS. 1 to 12. The bridge 25 extends across a circumferential gap 20 and interconnects the body 2 and the lid 3 of a closure. FIG. 13 *a*) shows the closure in a closed position. FIG. 13 *b*) shows the closure in an initial stage of opening with a partially stretched angled bridge 25 and FIG. 13 *c*) shows the lid in a state when the bridge 25 is broken. In difference to bridges as known from prior art, an angled bridge is shown provides a low stress level during initial opening such that the force necessary to open the closure builds up slowly in different to a straight bridge, which interconnects the closure parts directly. In addition, the angled bridges provide in different to bridges known from prior art good indication of initial opening due to strong deformation. By an appropriate choice of material, the bridges 25 provide change of color due to stress whitening. The force necessary to break the bridges can be adjusted by geometry. If appropriate, stress concentrating means can be forseen to adjust the forces necessary to destroy the bridges.

Figure 14:
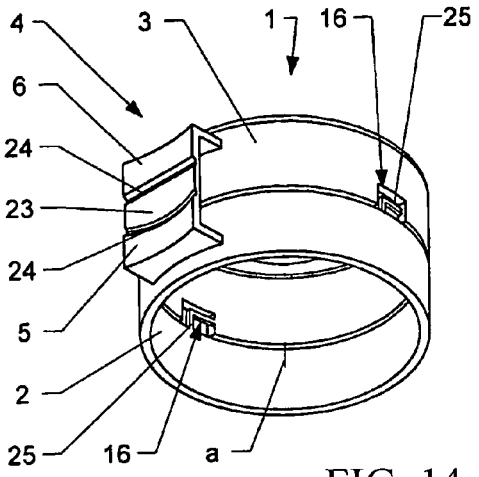
FIG. 14 a third embodiment of a closure with an external hinge in a perspective view from the back.
Figure 15:
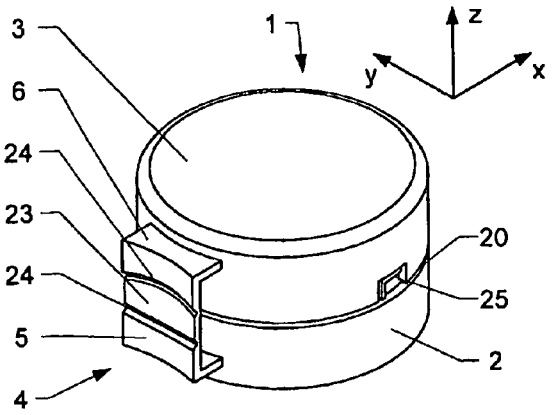
FIG. 15 the closure according to FIG. 14 in a perspective view from above.
Figure 16:
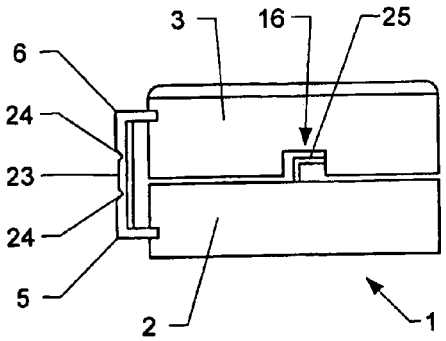
FIG. 16 the closure according to FIG. 14 in a side view.
Figure 17:
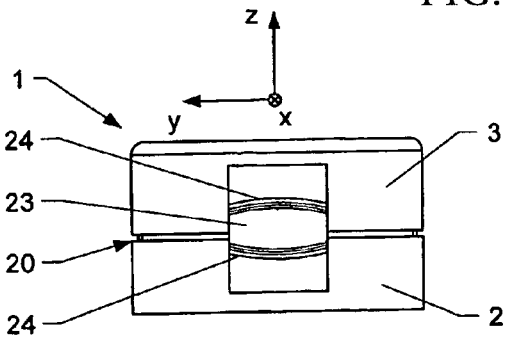
FIG. 17 the closure according to FIG. 14 in a rear view.
Figure 18:
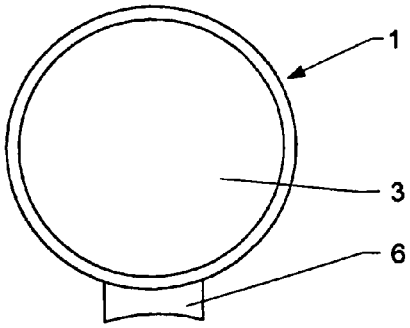
FIG. 18 the closure according to FIG. 14 in a top view.
Figure 19:
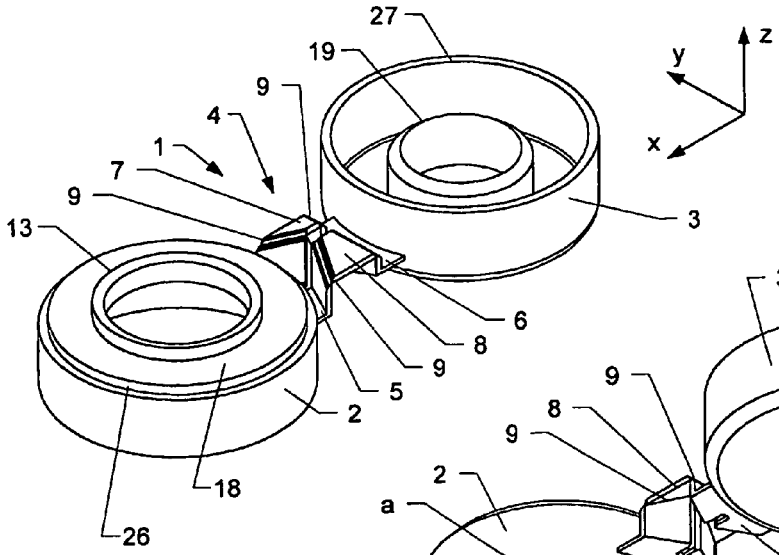
FIG. 19 a fourth version of closure with an external hinge in a perspective view from above.

FIGS. 14 to 18 are showing a third embodiment of a closure 1 according to the present invention. FIG. 14 is showing the closure in a perspective view from the rear and bellow and FIG. 15 in a perspective view from the rear and above. FIG. 16 is showing the closure 1 in a side view and FIG. 17 in a back view. FIG. 18 is showing the closure in a top view.

The in general cylindrical closure 1 is molded in a closed position and comprises a annular lower part 2 and a cap-like upper part 3 arranged coaxially to the lower part 2. The external hinge arrangement 4 comprises a first articulation element 5 and a second articulation element 6 rigidly interconnected to and protruding above an outer side wall of the closure parts 2, 3. The shown hinge arrangement 4 comprises one single intermediate element 23 which is interconnected to the first and the second articulation elements 5, 6 via spatially curved film hinges 24. As it can be best seen in FIG. 18 (top view) the intermediate element 23 has in a closed position of the closure 1 a concave shape which does not follow the principle direction of the outer contour of the closure parts 2, 3. As it can be best seen in in accordance with FIG. 17 (rear view) the two film hinges 24 are having in a closed position a convex (lens-like: "( )") arrangement with respect to each other, i.e. there end-sections are closest to each other. The intermediate element 24 of this embodiment is made bendable with around the z-axis such that it can be brought in an inverse position during the opening procedure of the closure. In difference to the hinge designs with to separate intermediate elements (see FIGS. 1 to 12) and straight film hinges 9, the hinge arrangement with a single intermediate element and curved film hinges has a lower hinge action due to loss of energy by bending of the intermediate element 24.

The closure 1 further is equipped with tamper evident elements 25 in the form of angled bridges as described in accordance with FIG. 13. Reference is made to the explanations in accordance to FIG. 13. The angled bridges 25 are arranged in two opposite windows 16 at an angle of 90° with respect to the arrangement of the hinge 4 reaching across a circumferential gap 20.

Figure 20:
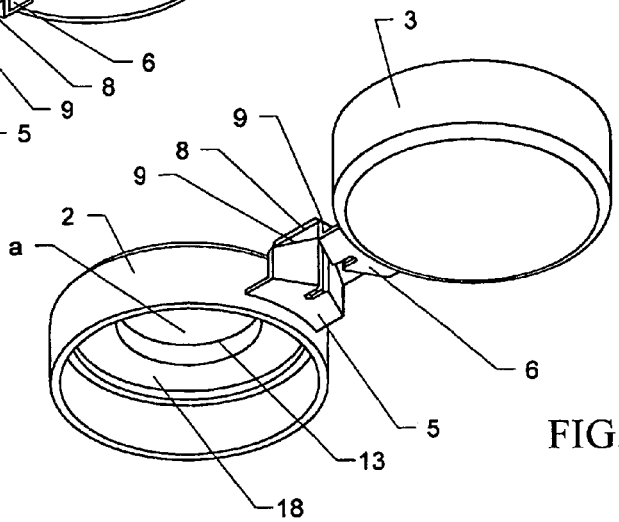
FIG. 20 the closure according to FIG. 19 in a perspective view from below.
Figure 21:
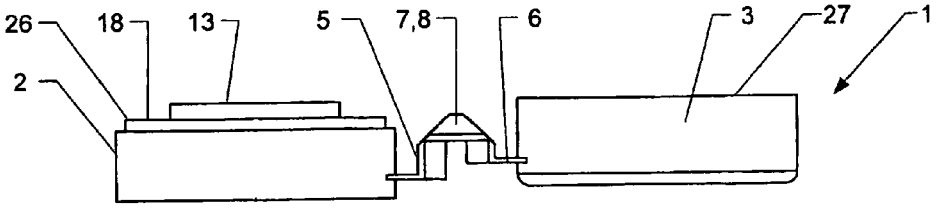
FIG. 21 the closure according to FIG. 19 in a side view.
Figure 22:
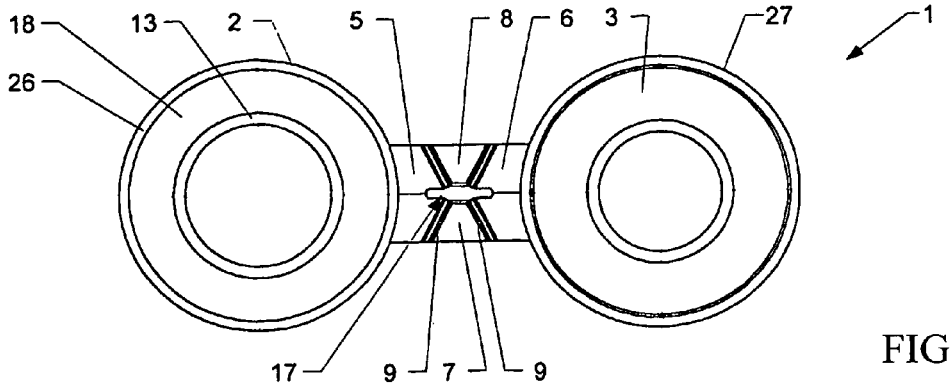
FIG. 22 the closure according to FIG. 19 in a top view.

FIGS. 19 to 22 are showing a fourth embodiment of a closure 1 with an external hinge arrangement 4. The closure 1 is shown in an open position in a perspective manner from above (FIG. 19) and below (FIG. 20). FIG. 21 is showing the closure 1 in a side view and FIG. 22 is showing the closure in a top view. The closure 1 is forseen to be made in an open position. As it can be concluded based on the geometry of the articulation elements 5, 6 and the film hinges 9, the trapezoid elements 7, 8 are convex when the closure is in the closed position, i.e. following the outer contour of the closure parts 2, 3. The lower closure part 2 comprises in the shown embodiment a top deck 18 and an orifice (pouring opening) 13 which could not be made in a closed position due to the resulting undercuts. The orifice 13 sealingly interacts in a closed position of the closure 1 with a plug 19 of the lid 3. The top deck 18 is in the shown embodiment separated by a circumferential shoulder 26 which tightly (sealingly) interacts in a closed position of the closure 1 with a rim 27 of the lid 3. In the shown embodiment the trapezoid elements 7, 8 (intermediate elements) are separated by a vertical gap 17.

NUMBERS

A Closure Axis
1 Closure
2 Body, Base Part
3 Lid, Upper Part
4 Hinge Arrangement
5 Lower articulation Element
6 Upper articulation Element
7 First Trapezoid Element
8 Second Trapezoid Element
9 Hinge Element, Film Hinge
10 First Plane
11 Second Plane
12 Insert (Lower Part)
13 Pouring Opening
14 Groove (Film Hinge)
15 Thin Web of Material
16 Window
17 Gap (between Trapezoid Elements)
18 Top Deck
19 plug
20 Circumferential Gap
21 Vertical Film Hinge
22 Thin Bridges of Material
23 Intermediate element (single)
24 Curved Film Hinge
25 angled bridge
26 Circumferential shoulder
27 Rim

What is claimed is:

1. A flip-top closure for a spout having a surrounding top deck and a lower skirt depending from the top deck, the flip-top closure comprising:

a pivotal cap comprising:

a top wall having an outer edge and a lower surface;

an upper skirt depending from the outer edge;

a sealing stopper depending from the lower surface;

an external hinge tethering the pivotal cap to the closure base, the external hinge comprising:

a bottom articulation wall protruding outwardly from the lower skirt;

a top articulation wall protruding outwardly from the upper skirt;

an outer sidewall extending between the top and bottom articulation walls and radially spaced from the upper and lower skirts, the outer sidewall having:

at least one of a gap and a film hinge extending along a central axis, the central axis extending in a substantially vertical direction; and a pair of trapezoidal elements mirrored along the central axis, each trapezoidal element defining a pair of film hinge legs respectively extending outward at a respective oblique angle away from the central axis.

2. The flip-top closure according to claim 1, wherein the external hinge is generally C-shaped.

3. The flip-top closure according to claim 1, further comprising an initial closed position wherein the closure base and the pivotal cap are secured by frangible bridge for indicating tamper evidence.

4. The flip-top closure according to claim 1, wherein the closure base and the pivotal cap are generally cylindrically shaped.

5. The flip-top closure according to claim 1, wherein the outer sidewall extends convexly outward in a radial direction away from the upper and lower skirts when the pivotal cap exists in a closed position.

6. The flip-top closure according to claim 1, wherein the outer sidewall extends concavely inward in a radial direction toward the upper and lower skirts when the pivotal cap exists in a closed position.

7. The flip-top closure according to claim 1, wherein the closure base and the pivotal cap are annular shaped.

8. The flip-top closure according to claim 1, wherein the lower skirt of the closure base is configured to fasten with a neck finish of a container.

9. The flip-top closure according to claim 1, wherein the lower skirt of the closure base is configured to receive an insert providing a pouring opening.

10. The flip-top closure according to claim 1, wherein the outer sidewall of the external hinge is laterally flexible, enabling the pivotal cap to pivot away from the closure base so that the external sidewall is transformed from an outer axial wall radially spaced from the pivotal cap and the closure base to an interior radial bridge joining the pivotal cap to the closure base with the pair of trapezoidal elements forming a raised central deck when the pivotal cap is in an open position.

* * * * *